US006804459B2

(12) United States Patent
Raghavan et al.

(10) Patent No.: US 6,804,459 B2
(45) Date of Patent: Oct. 12, 2004

(54) METHOD AND APPARATUS FOR CHANGING THE TEMPERATURE OF A PRESSURIZED FLUID

(75) Inventors: Chidambaram Raghavan, Kent, WA (US); Edmund Y. Ting, Kent, WA (US); Bruce M. Schuman, Kent, WA (US); Mohamed A. Hashish, Bellevue, WA (US)

(73) Assignee: Flow International Corporation, Kent, WA (US)

( * ) Notice: Subject to any disclaimer, the term of this patent is extended or adjusted under 35 U.S.C. 154(b) by 351 days.

(21) Appl. No.: 09/883,090

(22) Filed: Jun. 15, 2001

(65) Prior Publication Data

US 2002/0191970 A1 Dec. 19, 2002

(51) Int. Cl.[7] ..... F24H 1/10
(52) U.S. Cl. ..... 392/484; 392/465
(58) Field of Search ..... 392/465, 466, 392/484, 311; 72/54–56; 451/36, 38

(56) References Cited

U.S. PATENT DOCUMENTS

| | | | | |
|---|---|---|---|---|
| 2,611,585 A | * | 9/1952 | Boling | 165/164 |
| 2,680,802 A | * | 6/1954 | Bremer et al. | 392/321 |
| 2,687,626 A | * | 8/1954 | Bartlowe | 62/276 |
| 4,160,408 A | | 7/1979 | Ulvestad | 99/348 |
| 4,313,370 A | | 2/1982 | Skoli et al. | 99/323.1 |
| 4,334,141 A | * | 6/1982 | Roller et al. | 392/467 |
| 4,439,112 A | | 3/1984 | Kitsnik | 417/383 |
| 4,659,472 A | | 4/1987 | Nordlund et al. | 210/609 |
| 4,695,472 A | | 9/1987 | Dunn et al. | 426/237 |
| 4,789,313 A | | 12/1988 | Tower et al. | 417/388 |
| 5,048,404 A | | 9/1991 | Bushnell et al. | 99/451 |
| 5,075,124 A | | 12/1991 | Horie et al. | 426/577 |
| 5,213,029 A | | 5/1993 | Yutaka | 99/474 |
| 5,229,150 A | | 7/1993 | Ahnell et al. | 426/231 |
| 5,232,726 A | | 8/1993 | Clark et al. | 426/519 |
| 5,235,905 A | | 8/1993 | Bushnell et al. | 99/451 |
| 5,257,341 A | | 10/1993 | Austin, Jr. et al. | 392/487 |

(List continued on next page.)

FOREIGN PATENT DOCUMENTS

| | | |
|---|---|---|
| DE | 42 26 767 C1 | 9/1993 |
| DE | 44 06 028 A1 | 8/1995 |

(List continued on next page.)

OTHER PUBLICATIONS

Hayakawa et al., "Application of High Pressure for Spore Inactivation and Protein Denaturation," *J. of Food Science* *59*(1):159–163, 1994.

(List continued on next page.)

*Primary Examiner*—Thor Campbell
(74) *Attorney, Agent, or Firm*—Seed Intellectual Property Law Group PLLC

(57) ABSTRACT

An assembly for changing the temperature of ultrahigh-pressure fluid as it flows through ultrahigh-pressure tubing includes several thermally conductive blocks. Each block has a first bore through which the ultrahigh-pressure tubing passes, and a second bore containing a source of heating or cooling. Alternatively, resistance heating is used to increase the temperature of the ultrahigh-pressure fluid, by coupling electrodes to the outer surface of the tubing. The ultrahigh-pressure fluid is heated or cooled after it is pressurized, and is then discharged from the ultrahigh-pressure tubing at a selected temperature for use. For example, the ultrahigh-pressure fluid at a selected temperature may be discharged through a nozzle to form an ultrahigh-pressure fluid jet to cut or clean any desired surface or object, or it may be discharged to a pressure vessel to pressure treat a substance.

19 Claims, 4 Drawing Sheets

U.S. PATENT DOCUMENTS

| | | | | | |
|---|---|---|---|---|---|
| 5,265,318 | A | * | 11/1993 | Shero | 29/447 |
| 5,393,547 | A | | 2/1995 | Balaban et al. | 426/330 |
| 5,394,505 | A | * | 2/1995 | Bidare | 392/379 |
| 5,439,703 | A | | 8/1995 | Kanda et al. | 426/665 |
| 5,458,901 | A | | 10/1995 | Engler et al. | 426/521 |
| 5,475,983 | A | | 12/1995 | Yamamoto et al. | 62/62 |
| 5,571,476 | A | | 11/1996 | Newman | 422/26 |
| 5,579,682 | A | | 12/1996 | Bergman et al. | 99/473 |
| 5,658,610 | A | | 8/1997 | Bergman et al. | 426/665 |
| 5,724,478 | A | | 3/1998 | Thweatt | 392/484 |
| 6,017,572 | A | | 1/2000 | Meyer | 426/521 |
| 6,086,936 | A | | 7/2000 | Wilson et al. | 426/521 |
| 6,177,115 | B1 | | 1/2001 | Meyer | 426/521 |
| 6,283,832 | B1 | * | 9/2001 | Shepherd | 451/40 |
| 6,330,395 | B1 | * | 12/2001 | Wu | 392/494 |
| 6,442,341 | B1 | * | 8/2002 | Wu | 392/479 |

FOREIGN PATENT DOCUMENTS

| | | |
|---|---|---|
| GB | 338740 | 11/1930 |
| GB | 395709 | 7/1933 |
| JP | 62-66862 | 3/1987 |
| JP | 62-122546 | 6/1987 |
| JP | 1-110362 | 4/1989 |
| JP | 1-196251 | 8/1989 |
| JP | 2-89598 | 3/1990 |
| JP | 2-182157 | 7/1990 |
| JP | 2-245146 | 9/1990 |
| JP | 3-147772 | 6/1991 |
| JP | 3-292863 | 12/1991 |
| JP | 4-63569 | 2/1992 |
| JP | 4-299967 | 10/1992 |
| JP | 5-161483 | 6/1993 |
| JP | 6-7135 | 1/1994 |
| WO | WO 92/22748 | 12/1992 |
| WO | WO 94/21145 | 9/1994 |
| WO | WO 96/11588 | 4/1996 |
| WO | WO 97/21361 | 6/1997 |
| WO | WO 99/29187 | 6/1999 |
| WO | WO 99/38394 | 8/1999 |
| WO | WO 01/10773 A1 | 2/2001 |
| WO | WO 02/45528 A1 | 6/2002 |

OTHER PUBLICATIONS

Hayakawa et al., "Oscillatory Compared with Continuous High Pressure Sterilization on *Bacillus stearothermophilus* Spores," *J. of Food Science 59*(1):164–167, 1994.

Heremans (ed.), *High Pressure Research in the Biosciences and Biotechnology*, Leuven University Press, Leuven, Belgium, 1997, "Microbiological stabilisation of low acid food using a combined high pressure–temperature process," pp. 277–280.

Maggi et al., "Effects of Combined High Pressure–Temperature Treatments on Clostridium Sporogenes Spores in Liquid Media," *Ind. Conserve 71*:8–14, 1996.

Meyer et al., "High–Pressure Sterilization of Foods," *Food Technology 54*(11):67–72, 2000.

Rovere et al., "High–Pressure Heat Treatments: Evaluation of the Sterilizing Effect and of Thermal Damage," *Ind. Conserve 71*:473–483, 1996.

P. Rovere, "The Third Dimension of Food Technology, Next to time and temperature, a new and revolutionary operative parameter: high pressure," *Technologie Alimentari, Sistemi per Produrre*, No. 4, 1995.

* cited by examiner

METHOD AND APPARATUS FOR CHANGING THE TEMPERATURE OF A PRESSURIZED FLUID

TECHNICAL FIELD

This invention relates to the generation and use of ultrahigh-pressure fluid under controlled temperature conditions, and more particularly, to a system for changing the temperature of a pressurized fluid.

BACKGROUND OF THE INVENTION

Ultrahigh-pressure fluid has numerous uses. For example, ultrahigh-pressure fluid, generated by an ultrahigh-pressure pump, may be directed through a nozzle to form an ultrahigh-pressure fluid jet, which may or may not be mixed with abrasive material. Depending on the characteristics of the ultrahigh-pressure fluid jet, the jet may be used to cut or clean a variety of surfaces and objects, as is understood in the art. Ultrahigh-pressure fluid may also be directed to a pressure vessel to pressure-treat a substance. For example, it is known in the art that pathogens and microorganisms in substances, for example food, may be inactivated by exposing the substances to high pressure. While generating an ultrahigh-pressure fluid jet with fluid at ambient temperature provides acceptable results in many applications, applicants believe that it may be desirable in some situations to provide pressurized fluid for use at a selected temperature, above or below ambient. The present invention is therefore directed to selectively heating or cooling ultrahigh-pressure fluid.

SUMMARY OF THE INVENTION

Briefly, the present invention provides ultrahigh-pressure fluid at a selected temperature for use in any application that calls for the use of ultrahigh-pressure fluid. In preferred embodiments, the fluid is heated or cooled after it is pressurized. This is in contrast to heating or cooling the fluid prior to pressurization, which applicants believe may negatively affect the performance of an ultrahigh-pressure pump, particularly at extreme temperatures.

In a first preferred embodiment, ultrahigh-pressure fluid flows from its source, for example an ultrahigh-pressure pump, to its point of use, through ultrahigh-pressure tubing. The ultrahigh-pressure tubing is passed through a plurality of thermally conductive blocks, each block having a first bore through which the tubing passes. Each thermally conductive block is provided with a second bore, into which is positioned a source of heating or cooling. For example, a cartridge heater may be inserted into the second bore and set to a selected temperature. Alternatively, fluid at a selected temperature may be circulated through the second bore. In this manner, each thermally conductive block works as a heat exchanger, to create a heat flux across the ultrahigh-pressure tubing, thereby increasing or decreasing the temperature of the ultrahigh-pressure fluid, as desired. In a preferred embodiment, a thermocouple is provided in each block to sense the temperature of the block and/or the outer surface of the ultrahigh-pressure tubing, and provide feedback to a control loop, that in turn adjusts the temperature of the source of heating or cooling.

In another preferred embodiment, electrical resistance is used to heat the ultrahigh-pressure fluid as it flows through ultrahigh-pressure tubing. More particularly, a plurality of electrodes are coupled to an outer surface of the ultrahigh-pressure tubing and to a source of current. Preferably, a high current with a low voltage is used to reduce the likelihood of electric shocks. By passing a large current through the tubing, the entire cross section of the tubing effectively becomes the heat source. Without limiting the invention in any way, this invention may be particularly well suited to applications where heating to a high temperature is desired.

It will be understood that the number of blocks used and the arrangement of the blocks will be selected based on design parameters and the task at hand. For example, in a preferred embodiment, the number of blocks and the temperature of each block is selected based on the desired temperature of the ultrahigh-pressure fluid at the point of use, and the flow rate through the tubing.

DETAILED DESCRIPTION OF THE INVENTION

Figure 1:
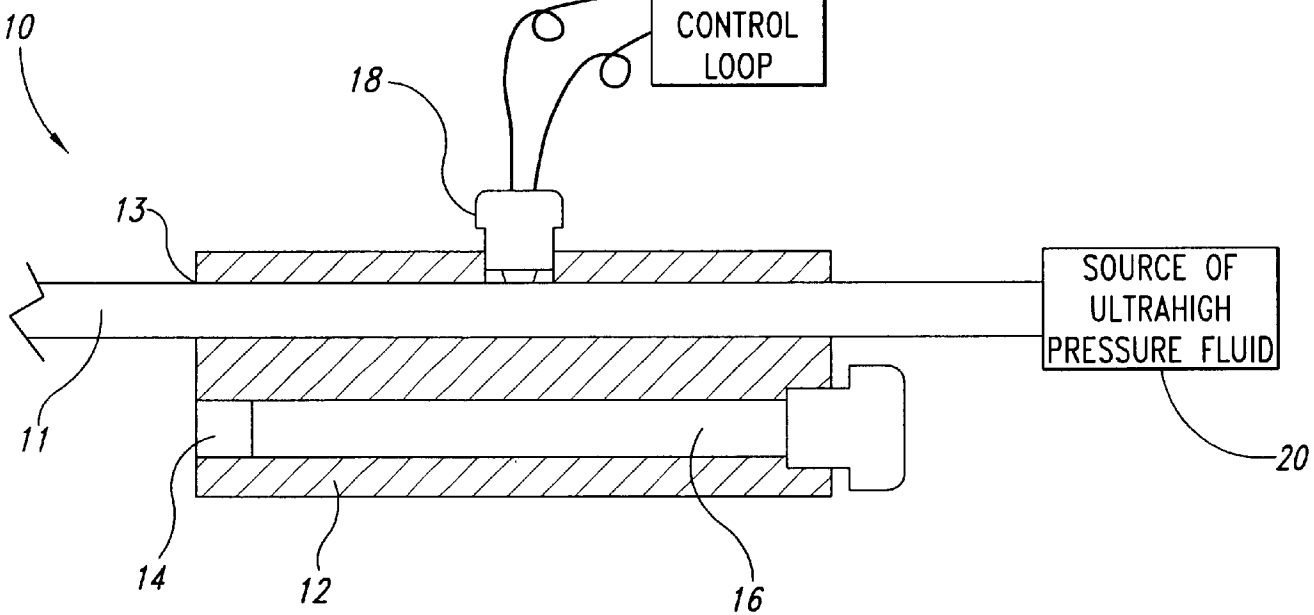
FIG. 1 is a schematic cross-sectional view of a device for heating or cooling fluid in ultrahigh-pressure tubing in accordance with a preferred embodiment of the present invention.
Figure 2:
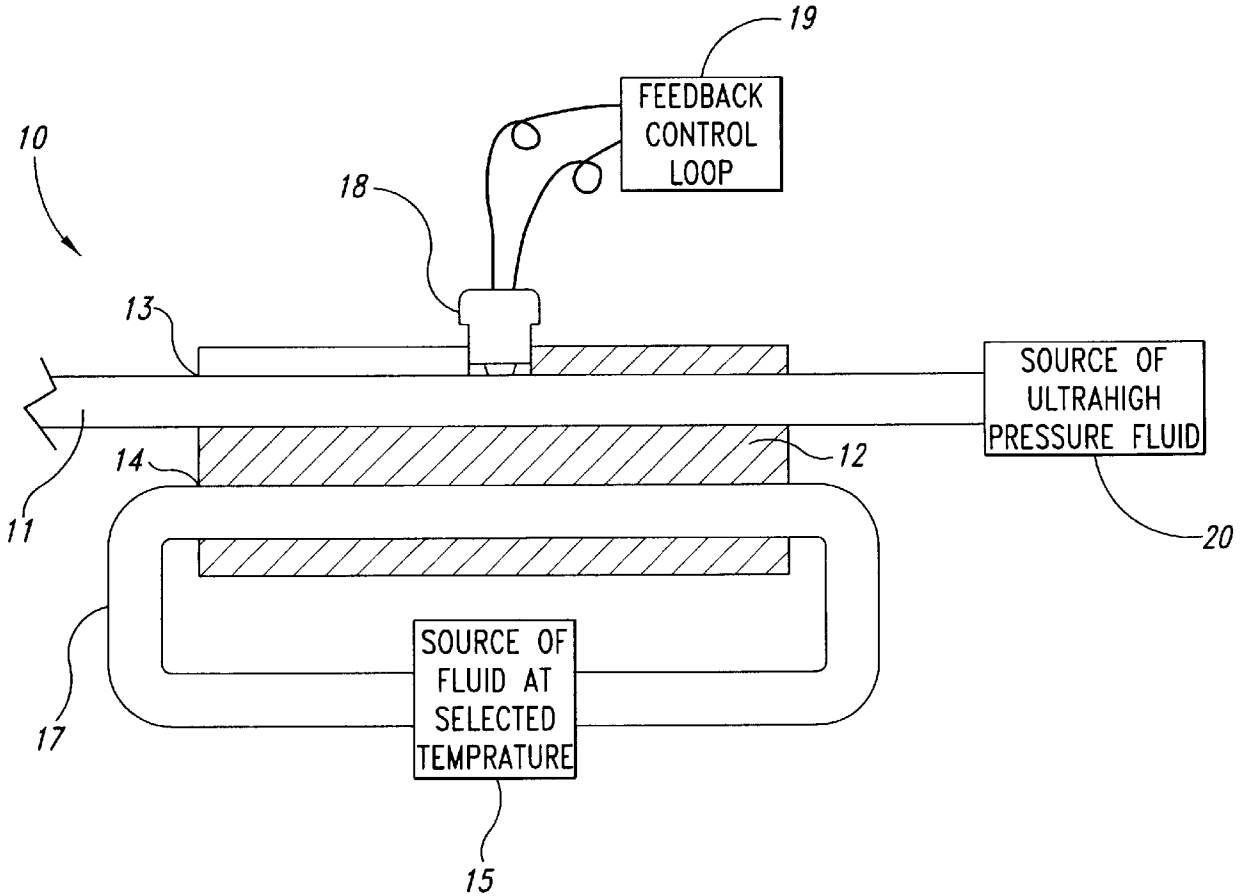
FIG. 2 is a schematic cross-sectional view of an alternative device for heating and cooling provided in accordance with the present invention.

As described previously, the present invention provides ultrahigh-pressure fluid at a selected temperature. In preferred embodiments, the temperature of the fluid is changed from ambient after the fluid is pressurized to the desired pressure and is discharged from the source of pressure 20 through ultrahigh-pressure tubing. In a preferred embodiment, as illustrated in FIG. 1, an apparatus 10 for changing the temperature of ultrahigh-pressure fluid includes a block 12 of thermally conductive material. While any thermally conductive material may be used, in a preferred embodiment, block 12 is made of aluminum. The block 12 is provided with a first bore 13 through which the ultrahigh-pressure tubing 11 passes. The block 12 is further provided with a second bore 14, which is provided with a source of heating or cooling. While any source of heating or cooling may be used, in a preferred embodiment, a cartridge heater 16 is positioned in the second bore 14. While any cartridge heater may be used, an example of an appropriate cartridge heater 16 is manufactured by Omega, item CIR-5069/240. Alternatively, as illustrated in FIG. 2, fluid 15 at a selected temperature is circulated through tubing 17 positioned in a circuit through second bore 14.

It will be understood that ultrahigh-pressure tubing 11 is thick walled and typically made of steel. In order to get the desired heat flux across the tubing 11 to the ultrahigh-pressure fluid flowing within it, it is desirable to monitor the system and adjust the temperature of the blocks as necessary to ensure that the ultrahigh-pressure fluid reaches the desired temperature. Although this may be accomplished in a variety of ways, in a preferred embodiment, a temperature sensor 18 such as a thermocouple is positioned on the block 12 to sense the temperature of the block and/or an outer surface of the tubing 11, and provide feedback to a control loop 19. A feedback control look 19 may in turn regulate the temperature of the source of heating or cooling, for example by adjusting the power supply to the cartridge heater. Alternatively, a temperature sensor may be positioned to sense the temperature of the fluid itself and provide feedback to the system accordingly. Monitoring the temperature of the block and/or an outer surface of the ultrahigh-pressure tubing may also be useful to ensure that the integrity of the tubing is not compromised. For example, stainless steel 316 ultrahigh-pressure tubing available from Autoclave Engineers, having an outer diameter of ⅜ inch and an inner diameter of ⅛ inch, can be taken up to approximately 450° F. with a loss of approximately 10% of its fatigue life. It would therefore be an objective of the system, when in use with this particular ultrahigh-pressure tubing, to ensure that the temperature of the outer surface of the tubing does not exceed 450° F.

Figure 3:
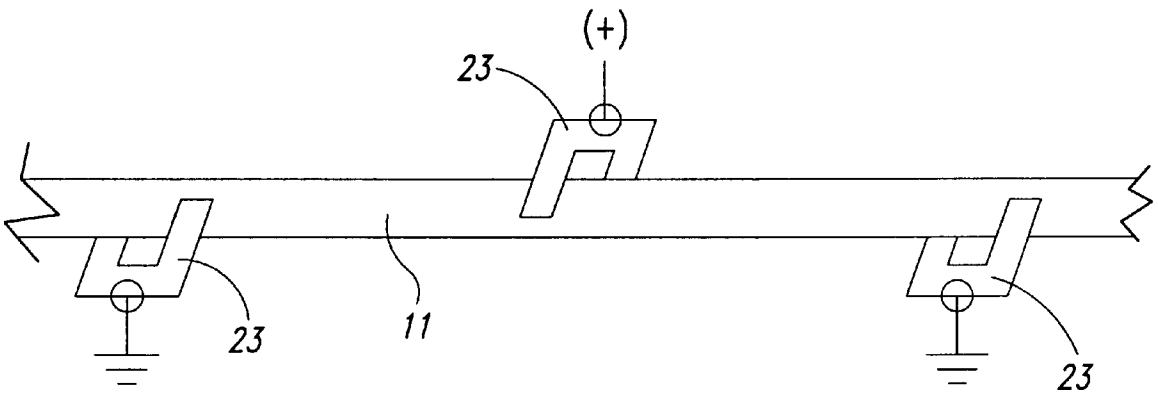
FIG. 3 is a schematic elevational view of an alternative device provided in accordance with the present invention.

In an alternative embodiment, as illustrated in FIG. 3, the ultrahigh-pressure fluid is heated as it flows through the ultrahigh-pressure tubing 11 using resistance heating. More particularly, as illustrated in FIG. 3, electrodes 23 are placed on an outer surface of the ultrahigh-pressure tubing 11, and connected to a source of current. By passing a large current through the tubing 11, the entire cross section effectively becomes a heat source. To eliminate the risk of electric shock, a low-voltage high current is used, for example 16 volts and 3000 amps to provide a 48 kW heating system. By placing a positive electrode in the center of the tubing and a grounded negative terminal on either side of it, the risk of electric shock is further reduced. Conventional transformers may be used to provide the desired level of current.

Figure 4:
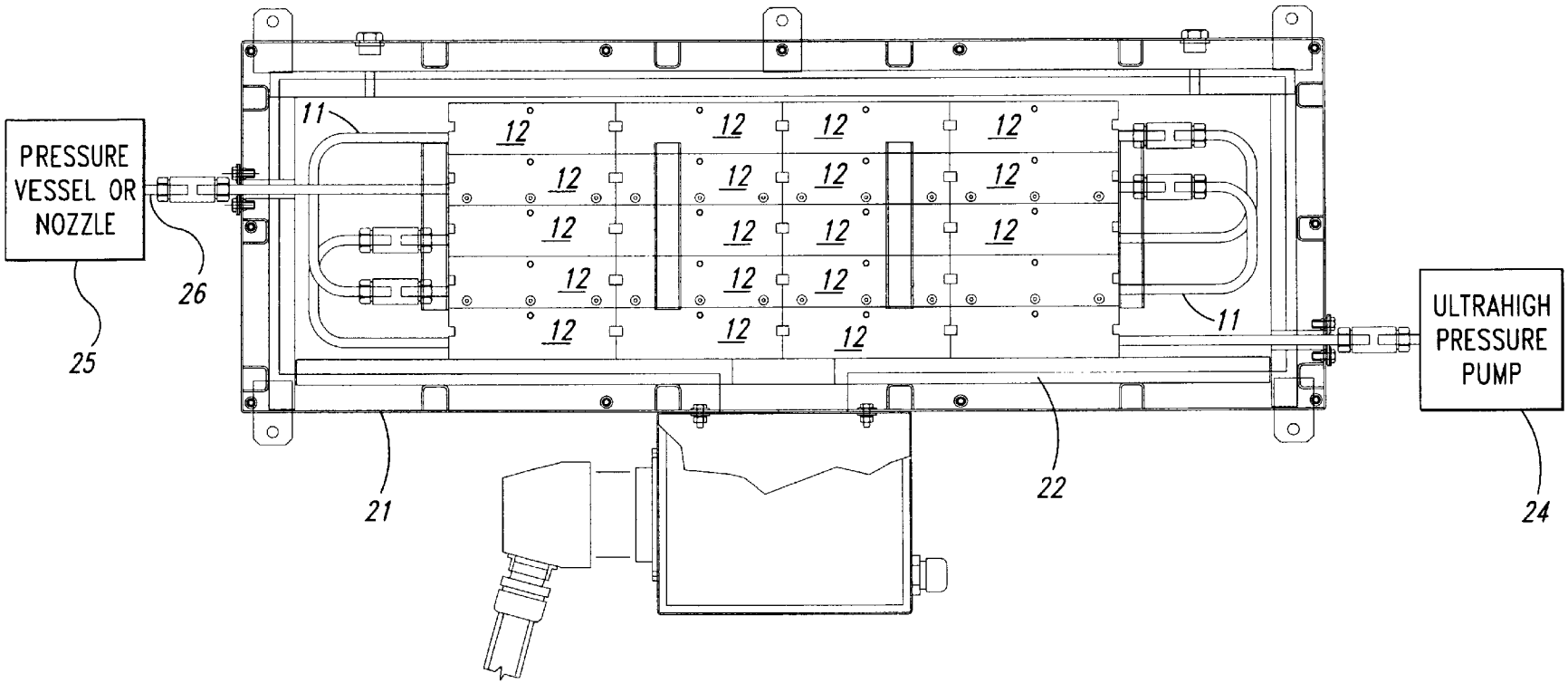
FIG. 4 is a top plan view of an assembly for heating or cooling fluid in ultrahigh-pressure tubing in accordance with the present invention.

In a preferred embodiment, as illustrated in FIG. 4, a plurality of blocks 12 are provided along a length of the ultrahigh-pressure tubing 11. Each block 12 has a construction and operation as described above. The exact number and layout of the number of blocks may be selected based on the particular application. In a preferred embodiment, the blocks 12 are mounted in a box 21 provided with insulation 22.

In operation, therefore, a volume of fluid is pressurized, for example, via an ultrahigh-pressure pump 24 shown schematically in FIG. 4. Ultrahigh-pressure pumps are commercially available, for example from Flow International Corporation, the assignee of the present invention. As the pressurized fluid flows through the ultrahigh-pressure tubing 11, it passes through the plurality of thermally conductive blocks 12, in which the source of heating or cooling has been activated. By the time the ultrahigh-pressure fluid reaches an outlet 26 of the ultrahigh-pressure tubing 11, it is at a desired temperature. The ultrahigh-pressure fluid at the selected temperature is then used as desired. For example, it may be discharged through a nozzle 25, shown schematically in FIG. 4. It will be understood that the ultrahigh-pressure fluid at a selected temperature may be discharged to any commercially available system for forming an ultrahigh-pressure fluid jet, for example those manufactured by Flow International Corporation. Depending on the application, the ultrahigh-pressure fluid jet at the selected temperature may be used to cut or clean, and may further entrain abrasives, depending on the desired application. Alternatively, the ultrahigh-pressure fluid at a selected temperature may be discharged to a pressure vessel to pressurize a substance contained in the pressure vessel. As described and claimed in a co-pending patent application entitled "Method and Apparatus for High-Pressure Treatment of Substances Under Controlled Temperature Conditions," Ser. No. 09/883.091, it may be desirable to pressure-treat substances, such as food, with a heated pressure media. This co-pending application is owned by Flow International Corporation, the assignee of the present invention, and the application is incorporated by reference into the present application.

As described previously, in a preferred embodiment, the temperature of one or more of the ultrahigh-pressure tubing 11, thermally conductive blocks 12, or the pressurized fluid, is measured, and the temperature of the source of heating or cooling is adjusted as needed to increase or reduce the temperature of the ultrahigh-pressure fluid. In a preferred embodiment, the thermally conductive blocks are heated or cooled to a selected temperature that is determined as a function of the flow rate of pressurized fluid through the ultrahigh-pressure tubing 11 and the desired change in temperature of the ultrahigh-pressure fluid. For example, in the system illustrated in FIG. 4, a three-phase electric power supply is used, such that eighteen thermally conductive blocks and two blanks are arranged in a grid. Extrapolating test data obtained from a four-block system, applicants believe that the temperature rise of the ultrahigh-pressure fluid may be defined by the following equation:

$$\text{Temperature rise}=(-0.3B+41)q+0.86B-102$$

where capital B is the block temperature in degrees Fahrenheit and q is the flow rate through the ultrahigh pressure tubing, in gallons per minute. It will be understood that the system shown in FIG. 4 and the above equation is merely illustrative of numerous systems that may be configured in accordance with the present invention, and an assembly may be configured in accordance with the present invention using any number of blocks.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An apparatus for changing the temperature of a pressurized fluid in ultrahigh-pressure tubing comprising:

a block that is thermally conductive and is provided with a first bore through which a length of ultrahigh-pressure tubing passes, the block being provided with a second bore containing a source of heating or cooling.

2. The apparatus according to claim 1 wherein a cartridge heater is positioned in the second bore.

3. The apparatus according to claim 1 wherein fluid at a selected temperature is circulated through the second bore.

4. The apparatus according to claim 1, further comprising a temperature sensor coupled to one or more of the block, the length of ultrahigh-pressure tubing, and the pressurized fluid.

5. The apparatus according to claim 4 wherein the temperature sensor is coupled to a feedback control loop to regulate a temperature of the source of heating or cooling.

6. The apparatus according to claim 1 wherein the block is made of aluminum.

7. An apparatus for changing the temperature of a highly-pressurized fluid in ultrahigh-pressure tubing comprising:

a length of ultrahigh-pressure tubing in fluid communication with a source of highly-pressurized fluid, a volume of highly-pressurized fluid selectively being allowed to flow through the ultrahigh-pressure tubing; and a plurality of thermally conductive blocks positioned along the length of ultrahigh-pressure tubing, each thermally conductive block having a first bore through which the ultrahigh-pressure tubing extends and a second bore containing a source of heating or cooling to change a temperature of the highly-pressurized fluid as it flows through the ultrahigh-pressure tubing.

8. The apparatus according to claim 7 wherein a cartridge heater is positioned in the second bore of each thermally conductive block.

9. The apparatus according to claim 7 wherein fluid at a selected temperature is circulated through the second bore of each thermally conductive block.

10. The apparatus according to claim 7, further comprising a temperature sensor positioned to sense a temperature of one or more of the blocks, the ultrahigh-pressure tubing, and the highly-pressurized fluid, the temperature sensor being coupled to a control feedback loop.

11. The apparatus according to claim 7 wherein a quantity of insulating material is positioned adjacent the thermally conductive blocks.

12. An apparatus for changing the temperature of a pressurized fluid in ultrahigh-pressure tubing comprising:

a length of ultrahigh-pressure tubing in fluid communication with a source of pressurized fluid, a volume of pressurized fluid selectively being allowed to flow through the ultrahigh-pressure tubing; and a plurality of electrodes coupled to an outer surface of the tubing and to a source of current.

13. A method for changing a temperature of ultrahigh-pressure fluid in ultrahigh-pressure tubing comprising:

passing a length of ultrahigh-pressure tubing through a plurality of thermally conductive blocks;

activating a source of heating or cooling in the thermally conductive blocks; and allowing ultrahigh-pressure fluid to flow through the ultrahigh-pressure tubing.

14. The method according to claim 13, further comprising:

measuring a temperature of one or more of the thermally conductive blocks, the ultrahigh-pressure tubing, or the ultrahigh-pressure fluid; and adjusting a temperature of the source of heating or cooling in the thermally conductive blocks as needed to increase or reduce the temperature of the ultrahigh-pressure fluid.

15. The method according to claim 13, further comprising:

heating or cooling the thermally conductive blocks to a selected temperature determined as a function of the flow rate of ultrahigh-pressure fluid through the ultrahigh-pressure tubing and the desired change in temperature of the ultrahigh-pressure fluid.

16. An ultrahigh-pressure assembly comprising:

an ultrahigh-pressure pump coupled to a source of fluid that is operational to generate ultrahigh-pressure fluid;

a length of ultrahigh-pressure tubing coupled to the ultrahigh-pressure pump, a volume of ultrahigh-pressure fluid selectively being allowed to flow through the ultrahigh-pressure tubing to an outlet of the ultrahigh-pressure tubing; and a plurality of thermally conductive blocks positioned along the length of ultrahigh-pressure tubing, each thermally conductive block having a first bore through which the ultrahigh-pressure tubing extends and a second bore containing a source of heating or cooling to change a temperature of the ultrahigh-pressure fluid as it flows through the ultrahigh-pressure tubing.

17. The assembly according to claim 16, further comprising a nozzle in fluid communication with the outlet of the ultrahigh-pressure tubing.

18. A method of cutting or cleaning with an ultrahigh-pressure fluid jet comprising:

pressurizing a volume of fluid with an ultrahigh-pressure pump to generate a volume of ultrahigh-pressure fluid;

discharging the ultrahigh-pressure fluid from the ultrahigh-pressure pump into ultrahigh-pressure tubing;

passing the ultrahigh-pressure tubing through one or more thermally conductive blocks;

activating a source of heating or cooling in the thermally conductive blocks, thereby changing a temperature of the ultrahigh-pressure fluid in the ultrahigh-pressure tubing to a desired temperature; and discharging the ultrahigh-pressure fluid at the desired temperature through a nozzle to form an ultrahigh-pressure fluid jet.

19. A method of pressurizing the contents of a pressure vessel with ultrahigh-pressure fluid at a selected temperature comprising:

pressurizing a volume of fluid with an ultrahigh-pressure pump to generate a volume of ultrahigh-pressure fluid;

discharging the ultrahigh-pressure fluid from the ultrahigh-pressure pump into ultrahigh-pressure tubing;

passing the ultrahigh-pressure tubing through one or more thermally conductive blocks;

activating a source of heating or cooling in the thermally conductive blocks, thereby changing a temperature of the ultrahigh-pressure fluid in the ultrahigh-pressure tubing to a desired temperature;

discharging the ultrahigh-pressure fluid at the desired temperature into a pressure vessel; and pressurizing the contents of the pressure vessel via the ultrahigh-pressure fluid.

* * * * *